United States Patent [19]

Minor

[11] 4,374,580

[45] Feb. 22, 1983

[54] SECURING DEVICE

[76] Inventor: Gerald G. Minor, 8800 N. Henley, Oklahoma City, Okla. 73113

[21] Appl. No.: 159,466

[22] Filed: Jun. 16, 1980

[51] Int. Cl.[3] ..... A47H 1/10

[52] U.S. Cl. ..... 248/317; 248/225.3 A

[58] Field of Search ..... 248/327, 317, 71, 57, 248/217.2, 225.3 A, 342, 343, DIG. 6, 644; 52/39; 212/139

[56] References Cited

U.S. PATENT DOCUMENTS

| | | | |
|---|---|---|---|
| 472,756 | 4/1892 | Glenn | 212/139 X |
| 2,691,503 | 10/1954 | Bigelow | 248/354 H |
| 2,713,983 | 7/1955 | Kay | 248/57 |
| 2,964,279 | 12/1960 | Galloway | 248/57 X |
| 4,078,753 | 3/1978 | Cole | 248/317 X |

FOREIGN PATENT DOCUMENTS

| | | | |
|---|---|---|---|
| 439181 | 12/1967 | Switzerland | 248/217.2 |
| 703064 | 1/1954 | United Kingdom | 248/317 |

*Primary Examiner*—J. Franklin Foss

*Attorney, Agent, or Firm*—Christopher H. Morgan

[57] ABSTRACT

A securing device for securing objects with respect to spaced apart beams or the like. A rigid extensible member is provided for bridging the span between the beams and securely pressing its ends against the beams. A non-rigid support such as a chain is connected to the ends of the rigid extensible member and secures the object such that a binding force is not exerted on the midportion of the rigid extensible device. If desired, a hydraulic jack can be utilized as the rigid extensible member.

5 Claims, 2 Drawing Figures

SECURING DEVICE

BACKGROUND OF THE INVENTION

1. Field of the Invention

This invention relates generally to securing or anchoring devices and more particularly to devices used for securing, raising, or lowering objects with respect to spaced apart stationary surfaces of walls or beams or the like.

2. Description of the Prior Art

Various devices have been used to anchor or suspend objects from spaced apart members. While some of the devices rely on bolts or screws inserted into the members, others do not since it is frequently impractical to use such bolts or screws. For example, if a beam is made of steel or iron a bolt attachment requires tedious drilling. Even if the connection is to a wooden beam, drilling or inserting bolts is time consuming. Furthermore, if the connection is only temporary, the bolts are difficult to remove and leave permanent holes.

One variety of screwless and boltless securing devices has a pair of beam engaging ends which are moved apart and then held securely against opposing beams or the like. These devices are often very specific in their design and use. One of these is the chinning bar of the type connected in a door frame to provide a secure handhold for chinning exercises. Another is the hanger bar connected between closet walls to provide a receiver for clothes hangers. Other related or similar devices will be described below. Each of these prior art devices has a rigid connection and support member having on its ends two beam-engaging parts. The rigid connection and support member spans the gap between the opposing beams or walls to retain the engaging parts in connection with the beams or walls. It also serves to receive and support the retained object.

The chinning bar exemplifies the prior art. The chinning bar consists of a steel bar (connecting and support member) having two portions which are threaded together. At the outer ends of this bar are rubber discs (end members) adapted to resiliently engage a door frame. To mount the chinning bar, the threaded connection of the steel bar is adjusted by rotation to urge the rubber discs outwardly into resilient engagement with the door frame. Once it is securely mounted, chinning exercises can be performed by grasping a central portion of the bar and lifting the body relative to the bar. Other devices which have similar components are shown in U.S. Pat. Nos. 1,099,834; 2,713,983; 3,648,425; 3,892,378; 2,604,303; 3,049,328 and 3,281,107.

U.S. Pat. No. 1,099,834 discloses a compact fire escape which can be secured to a window frame. In operation, persons are lowered to the ground by a cable wound about a rotatable drum. The drum is secured to a wooden window frame by a pair of rods each of which is sharpened at its outer end to allow the end to pierce the window frame and be secured thereto. This allows the drum to be held between the window frame edges. The sharpened rods allow fast placement of the drum in an emergency.

U.S. Pat. No. 2,713,983 describes a bar used for supporting electrical outlet boxes. The bar has a threaded tubular portion with prongs on each end of the tube. When the tube threads are rotated the prongs move outwardly to engage, for example, attic joists. An electrical outlet box is connected to and supported by a midportion of the bar.

U.S. Pat. No. 3,648,425 depicts an adjustable bridging device for stabilizing floor joists. The device includes threaded telescoping portions adapted to engage the joists. One end of the device has two pointed prongs for engaging a joist such that one telescoping portion cannot rotate axially. The other end has a single central prong for penetrating a joist, allowing the telescoping member to rotate about the prong as it is inserted. Once in place, the telescoping members span and add stability to the joists.

U.S. Pat. No. 2,604,303 discloses a combined hoist and jack. The hoist is used to handle and brace timber, props, etc., in tunnels and mine shafts. The ends of the jack adjustably extend between the floor and the ceiling of the tunnel with prongs being provided on the upper end to engage the ceiling. A hoist pulley is attached to a central portion of the bar.

U.S. Pat. No. 3,049,328 discloses a cargo bracing device. The device consists of a pair of telescoped bars that extend into first contact with opposite walls of a cargo truck or vehicle. A rack and pinion gear operates to extend the bar.

U.S. Pat. No. 3,281,107 to Lewis depicts a hydraulic support prop including two ends which are caused hydraulically to move in opposite directions.

As can be seen, the prior art utilizes a central support bar which receives the entirety of the supported or secured weight in a manner which exerts a bending force on the bar. This requires the central bar to be doubly strong. First, it must have strength to hold the ends against the spaced apart beams or the like. Second, it must have strength to resist bending when a secured object is attached to the bar. For example, the chinning bar described above must be designed to urge its rubber disc end caps against a door frame hard enough to prevent the caps from slipping and the bar must not bend when a body weight is applied to the center of the bar. Consequently, the prior art securing devices can receive only a relatively small weight without the bar bending or breaking.

The devices in the past have attempted to overcome this problem by making the central bar stronger and, consequently, larger and heavier. Furthermore, the means for spreading and holding the ends of these devices to the spaced apart beams has been made more complex and bulky. The additional weight is itself a disadvantage. Moreover, complex and bulky devices often cannot be used in confined areas.

One particular situation where it is desirable to raise and lower heavy objects with respect to spaced apart wood beams is in an attic or basement. Often water heaters or air conditioners must be lifted or lowered with respect to the joists in the attic or basement. Usually there is no other convenient object to which the lifting or lowering means can be attached. In an attic or basement, the onfining and relatively restricted working space makes bulky or heavy devices unsuitably difficult to use. The objects are too heavy for normal, smaller securing bars. Consequently, securing heavy objects with respect to attic joists has, in the past been a tedious task, usually requiring bolts or screws or the like.

SUMMARY OF THE INVENTION

It is accordingly an object of the present invention to provide an improved device for securing objects with respect to spaced apart stationary surfaces.

It is also an object of the present invention to provide such a device which has a simple and compact structure and can secure relatively heavier objects.

Another object of the invention is to provide such a device which is smaller and easier to install or mount.

A further object of the invention is to provide such a device that is sufficiently compact to allow the operator to work in a confining or restricting area such as an attic or basement.

Accordingly, the device for securing objects with respect to stationary surfaces of the present invention has a first engagement member and a second engagement member for engaging the spaced apart stationary surfaces. The first and second engagement members are oriented to point in opposite outward directions along a common axis. Connected to the first and second engaging members is a spreading means to relatively spread the first and second engagement members and to securely press the engagement members against their respective stationary surfaces. An attachment means is provided for connecting objects to the device. The attachment means comprises a flexible suspension member one end of which is connected to the first engagement member and the other end of which is connected to the second engagement member.

For a further understanding of the invention and further objects, features and advantages thereof, reference may now be had to the following description taken in conjunction with the accompanying drawings.

DESCRIPTION OF PREFERRED EMBODIMENTS

Figure 1:
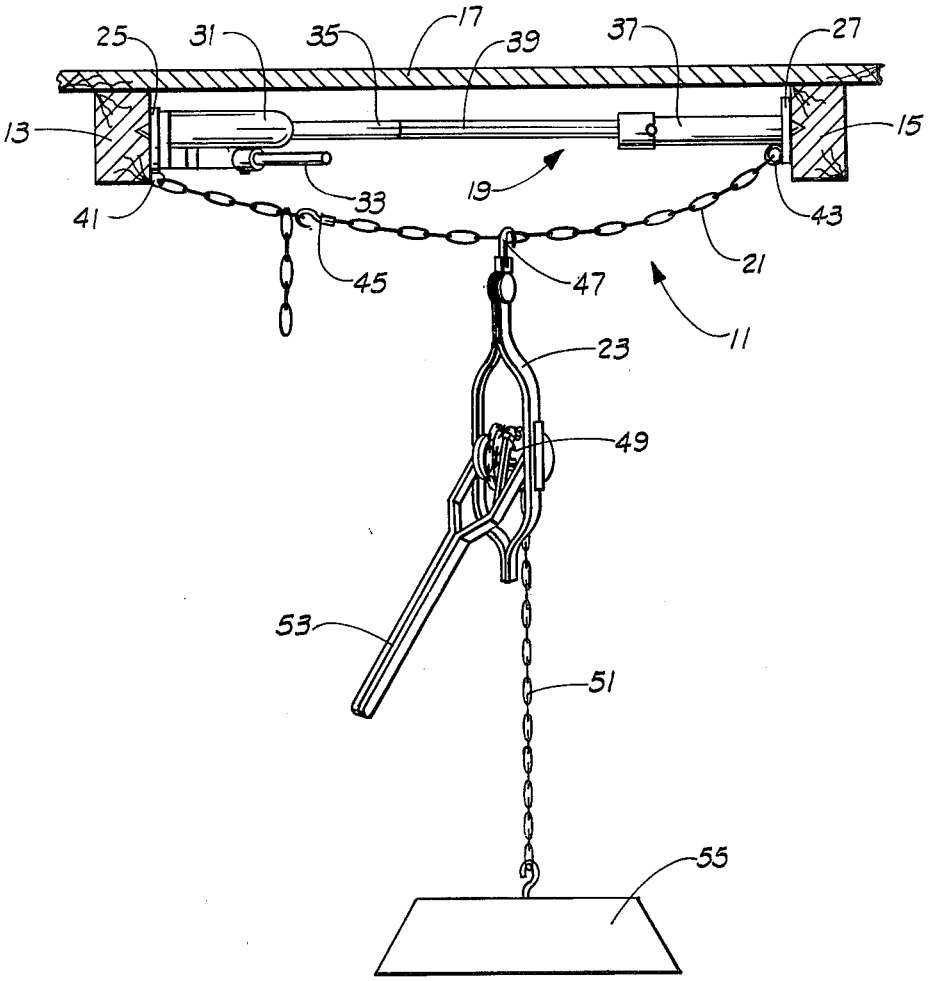
FIG. 1 is a side view of the present invention attached to joists in an attic (shown in cross-section).

Referring to FIG. 1, the device of the present invention is shown generally at 11. The device 11 is shown secured to left attic joist 13, a right attic joint 15 and beneath an attic ceiling or roof 17. In FIG. 1, the joists 13 and 15 and the roof 17 are shown in cross-section. The device 11 is shown in side view.

The joints 13 and 15 are wooden two-by-four's or the like of the type normally used for supporting the attic roof 17. The device 11 allows objects to be secured, raised or lowered with respect to joists 13 and 15. Thus, the present invention can be used in the process of installing or removing water heaters, air conditioning equipment, heating equipment or the like.

The device 11 consists of a rigid extensible bridge 19, a chain 21 and a hoist 23. The extensible bridge 19 bridges the span between the joists 13 and 15 and securely presses the ends of the extensible bridge 19 against the joists. The chain 21 is attached to the ends of the extensible bridge 19 and non-rigidly bridges the span between the ends of the extensible bridge 19. One end of hoist 23 is connected to the chain 21. The other end of hoist 23 is connected to the object which is to be secured with respect to the chain 21, and ultimately, joists 13 and 15.

Figure 2:
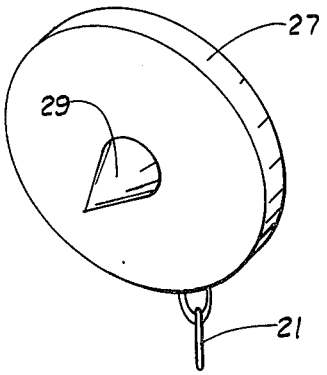
FIG. 2 is a perspective view of an end portion of the device shown in FIG. 1.

The extensible bridge 19 has on its left end a disc 25 and on its right end, a disc 27. The outer flat surfaces of discs 25 and 27 are disposed transverse to the longitudinal axis of bridge 19 and engage the joists 13 and 15, respectively. At the axial center of discs 25 and 27 are conical points. These points are disposed along the longitudinal axis of bridge 19 at each end of bridge 19. As can be seen in FIG. 2, the conical point 29 of disc 27 extends outwardly such that as the disc 27 engages a soft surface such as wood, the point 29 is inserted into the wood. In this manner, the discs 25 and 27 are held with respect to joists 13 and 15 by more than friction.

The inner surface of disc 25 is connected to the base of a hydraulic jack 31. The hydraulic jack 31 provides the spreading force for pressing discs 25 and 27 against joists 13 and 15. The hydraulic jack 31 is a conventional type and is actuated by a manual lever 33. As the jack 31 is actuated, a shaft 35 of the jack moves with respect to the body of jack 31. This shaft 35 is located axially between the discs 25 and 27 such that as the jack operates the discs are moved apart or together.

Connected to the inwardly facing surface of disc 27 is a pipe 37. Pipe 37 forms a sleeve for receiving shaft 35 of hydraulic jack 31. This secures the disc 27 with respect to the end of shaft 35.

As jack 31 is operated, the distance spanned by discs 25 and 27 is varied. This distance, however, is limited by the operational limits of the hydraulic jack 31. To increase this span, an extension pipe 39 can be threadedly connected to the inner end of pipe 27. This extension pipe 39 forms a sleeve for shaft 35 and holds the shaft 35 at a distance further from disc 27.

Eyelets 41 and 43 are connected to discs 25 and 27, respectively, and receive the end links of chain 21. Midway along chain 21 is a hook 45 which allows the length of chain 21 to be varied. Hook 45 can be hooked to various links of the opposing section of chain 21 to vary the chain length between eyelets 41 and 43.

The upper end of hoist 23 is provided with a hook 47. Hook 47 can be inserted in a selected one of the links of chain 21. This allows the hoist 23 to be positioned as desired along the length of chain 21.

Hoist 23 has a pawl-and-gear mechanism 49. This mechanism 49 is connected to a drum on which is wound a chain 51. A handle 53 actuates the pawl-and-gear mechanism to turn the drum and raise or lower chain 51. The lower end of chain 51 is connected to the object which is desired to be secured, raised or lowered. In FIG. 1 a weight 55 is shown connected at the lower end of chain 51. Normally, however, a water heater or the like would be attached as described above.

To operate the device 11, the jack 31 is prepared by positioning the shaft 35 in its non-extended position. Next, the distance to be bridged by the rigid extension 19 is surveyed to determine the length of span. This determines whether an extension must be used or the length of the extension required. A proper size extension 39 is then threaded to pipe 37. The shaft 35 of jack 31 is then inserted in the sleeve of extension 39. The bridge 19 is positioned loosely between joists 13 and 15. Handle 33 is operated to extend the shaft 35 and to spread the discs 25 and 27 into contact with the joists 13 and 15. When the discs have been securely pressed against the joists 13 and 15 and the points of discs 25 and 27 securely inserted therein, actuation of the lever 33 of jack 31 is halted.

Once the rigid bridge 19 is positioned between and secured to the joists 13 and 15, the hook 45 of chain 21 is hooked through an appropriate link of the opposing portion of chain 21. It is desirable to adjust the length of chain 21 such that there is as little sag to the chain as possible.

Next, the hook 47 of hoist 23 is hooked into an appropriate length of chain 21 to position the hoist 23 directly above the object to be secured, raised or lowered. The lower end of chain 51 is then attached to the object to be secured. Actuation of handle 53 of joist 23 raises or lowers the object attached to the end of chain 51.

From the above description, it is clear that the present invention provides several advantages over the prior art. The attachment of joist 23 to chain 21 avoids putting a bending stress on the center of bridge 19. This allows the object to be held more securely with a lighter weight device. Also, the bridge can be quickly and easily installed and removed. Furthermore, attachment of the bridge does not permanently damage the joists 13 and 15.

If desired, the points on discs 25 and 27 can be decreased in size, or removed, to prevent the joists 13 and 15 from being marred in any way. Friction alone, however, is often not sufficient to retain the bridge when extremely heavy objects are secured.

Thus, the securing device of the present invention is well adapted to attain the objects and advantages mentioned as well as those inherent therein. While presently preferred embodiments of the invention have been described for the purpose of this disclosure, numerous changes in construction and arrangement of parts can be made by those skilled in the art which changes are encompassed within the spirit of this invention as defined by the appended claims.

The foregoing disclosure and the showings made in the drawings are merely illustrations of the principle of this invention and are not to be interpreted in a limiting sense.

What is claimed is:

1. A device for securing objects with respect to spaced apart first and second pierceable and opposed stationary surfaces comprising:

a first piercing engagement member for engaging and piercing said first stationary surface to provide a first base secured against movement along said first stationary surface;

a second piercing engagement member for engaging and piercing said second stationary surface to provide a second base secured against movement along said second stationary surface, said first and second engagement members being disposed along a common axis;

spreading bar means connected to said first and second engagement members for relatively spreading said first and second engagement members to securely pierce and press each of said engagement members against a respective one of said first and second stationary surfaces wherein said spreading bar means includes a jack for spreading said first and second engagement members into said first and second stationary surfaces and providing a compression load bearing support between said first and second engagement members; and flexible suspension means extending in a single flexible span from said first to said second engagement member and attached thereto for suspending and securing an object with respect to said first and second engagement members adjacent to said first and second stationary surfaces, said flexible suspension means flexibly bearing the load of an object such that the load of an object suspended and secured to said suspension means is received as a compression load on said spreading bar means and as a load urging said first and second engagement members to move along said first and second stationary surfaces.

2. The device of claim 1, wherein said first and second engagement members have, respectively, first and second points extending in opposite outward directions along a common axis for insertion into and piercing of said first and second spaced apart surfaces.

3. The device of claim 2, wherein said hydraulic piston is actuated by a hand lever.

4. The device of claim 1, which further comprises an extension bar member removably disposed between said spreading bar means and said first engagement member such that, when said extension member is disposed between said spreading means of said first engagement member, the spreadable distance of said first and second engagement members is increased.

5. The device of claim 4, which further comprises hoist means connected to an intermediate portion of said flexible suspension means for raising and lowering objects with respect to said flexible suspension member.

* * * * *